United States Patent [19]

Gonzales

[11] Patent Number: 4,827,701

[45] Date of Patent: May 9, 1989

[54] SADDLE PAD CONSTRUCTION

[76] Inventor: Anthony Gonzales, 13602 Ellendale Dr., Chantilly, Va. 22021

[21] Appl. No.: 103,672

[22] Filed: Oct. 2, 1987

[51] Int. Cl.[4] ..... B68C 1/12

[52] U.S. Cl. ..... 54/66

[58] Field of Search ..... 54/44, 65, 66

[56] References Cited

U.S. PATENT DOCUMENTS

| | | | |
|---|---|---|---|
| 441,253 | 11/1890 | Oelkuck | 54/66 |
| 2,072,188 | 3/1937 | Tauber | 54/66 |
| 4,669,255 | 6/1987 | Wicks | 54/66 |
| 4,683,709 | 8/1987 | Vasko et al. | 54/66 |

FOREIGN PATENT DOCUMENTS

| | | | |
|---|---|---|---|
| 4396 | of 1900 | United Kingdom | 54/66 |
| 390677 | 4/1933 | United Kingdom | 54/66 |
| 426078 | 3/1935 | United Kingdom | 54/66 |

*Primary Examiner*—Robert P. Swiatek
*Attorney, Agent, or Firm*—Frank P. Presta

[57] ABSTRACT

A saddle pad for a horse or the like, the pad having a predetermined saddle-supporting contour and comprising an upper pad portion and a lower pad portion. Flexible and resilient cushioning members are disposed between the upper and lower pad portions, and are located in the areas where the seat and upper leg portions of a rider apply pressure to the horse during riding movement. The cushioning members serve to cushion shocks on the back and sides of the horse to prevent soreness and lameness of the horse, and to improve the comfort of the rider.

7 Claims, 2 Drawing Sheets

SADDLE PAD CONSTRUCTIONR

BACKGROUND OF THE INVENTION

The present invention relates to pads for use under riding saddles and, more particularly, to a new and improved saddle pad which provides a maximum degree of comfort for both the rider and the animal, e.g., a horse, particularly at the contact points of the rider's seat and legs on the horse.

Heretofore, it has been customary to employ a pad of felt or fabric, or a blanket between the ordinary riding saddle and the horse, the primary purpose being to prevent the saddle from chafing the horse. These pads or blankets are comparatively short lived and do not serve particularly well the purposes for which they are used, especially the cushioning of shocks and pressure on the horse's back and sides resulting from the contact of the rider's seat and legs on the horse. A particular aim of the present invention, therefore, is to provide an improved saddle pad that will not only wear longer than saddle pads heretofore in use, but will serve more effectually to prevent chafing and soreness, while at the same time increasing the comfort and leg contact of the rider.

SUMMARY OF THE INVENTION

The present invention provides a saddle pad having a pronounced cushioning action whereby it will afford comfort, by reason of this cushioning action, both to the rider and the animal, by taking up the shocks incident to the lack of coordination of the movements of the rider and the animal. Also, the pad of the present invention is constructed to allow for improved contact of the rider's lower leg portions with the sides of the horse to improve control of the horse.

The pad of the present invention is formed of a flexible and resilient material, such as foamed polyurethane, and comprises upper and lower pad portions that are joined together at their end portions and cushioning members located between the upper and lower pad portion. The cushioning members are positioned in the areas of the saddle pad where the seat and upper leg portions of the rider apply pressure to the back and sides of the horse to minimize soreness and lameness of the horse. Preferably, the sides of the pad are shorter than conventional pads so that the knee and lower leg portions of the rider can make better contact with the sides of the horse through the side flaps of the saddle.

DESCRIPTION OF THE PREFERRED EMBODIMENTS

Figure 1:
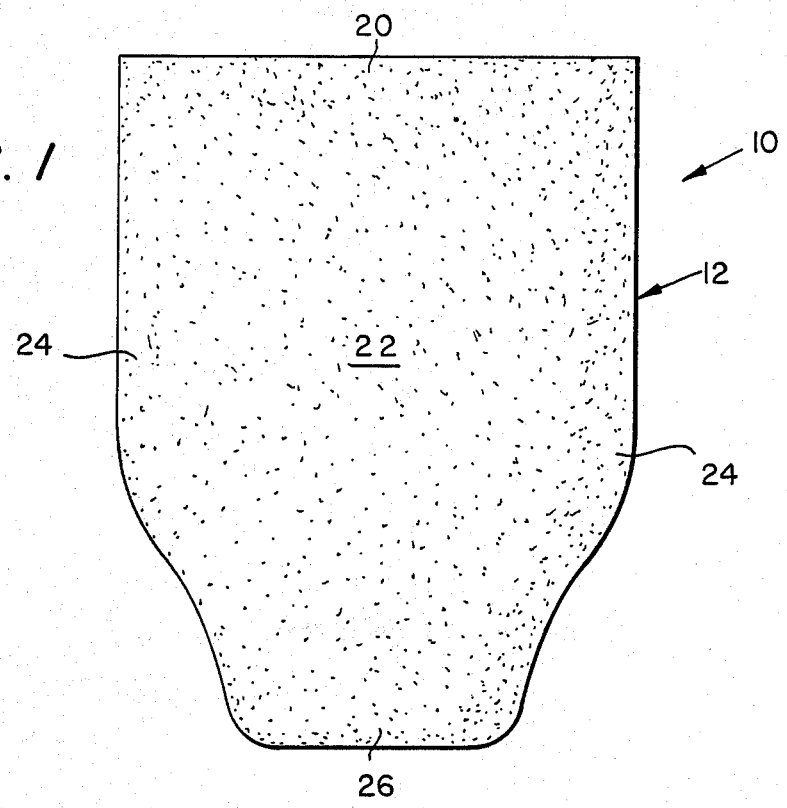
FIG. 1 is a top plan view of the saddle pad of the present invention.
Figure 2:
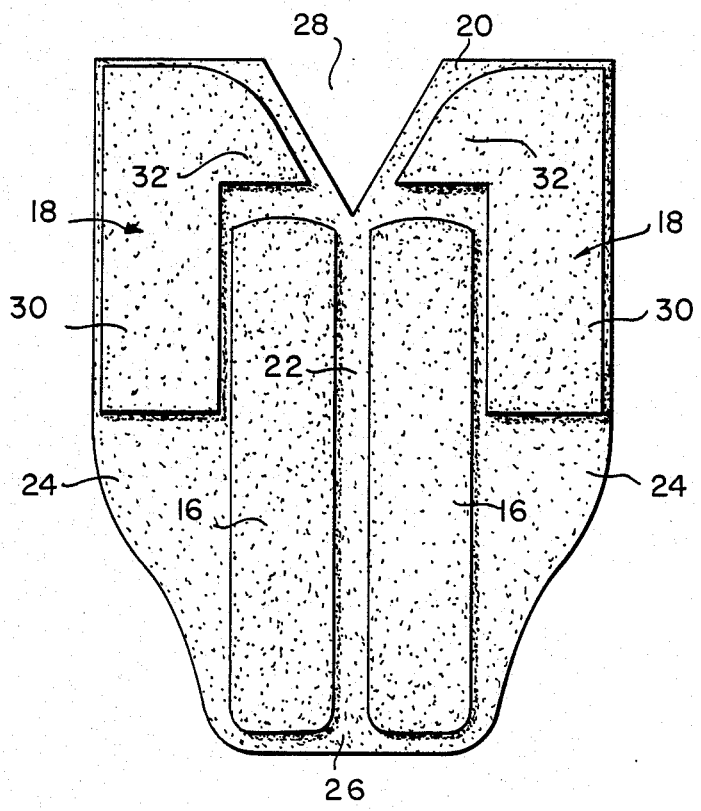
FIG. 2 is a top plan view of the lower portion and intermediate cushioning members of the saddle pad.

FIGS. 1 and 2 illustrate the components of the saddle pad 10 of the present invention, namely, the upper pad portion 12, the lower pad portion 14 and the intermediate cushioning members 16 and 18. The saddle pad 10 has a predetermined saddle-supporting contour and comprises a front section 20, a mid-section 22, side sections 24 and an inwardly tapered rear section 26. The upper and lower pad portions 12 and 14 are of a similar size and shape, with the exception that the lower pad portion 14 may be provided with a generally V-shaped opening 28 in its front section for the purpose of providing a thinner area of the pad near the withers of the horse and beneath the pommel of the saddle.

Figure 3:
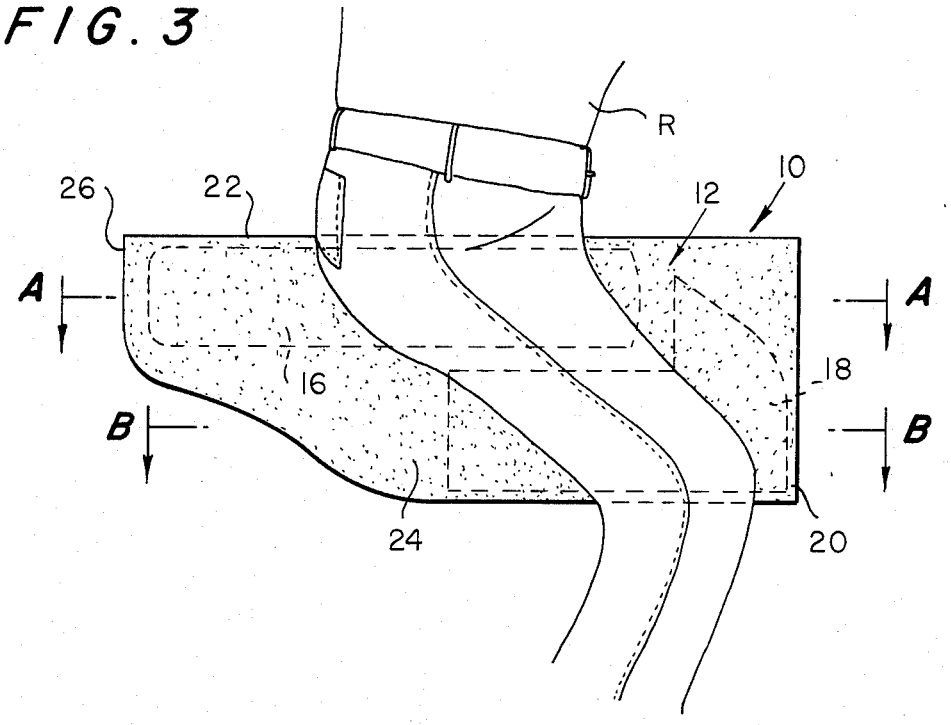
FIG. 3 is a side elevational view of the saddle pad of the present invention.

The cushioning members 16 and 18 are disposed between and secured to the upper and lower pad portions 12 and 14. As shown in FIGS. 2 and 3, the cushioning members 16 are elongated and extend from the rear section 26 of the pad forwardly through the mid-section 22 to approximately the inner end of the opening 28 in the lower pad portion 14. Each of the cushioning members 16 is of a width that is approximately half the width of the side sections 24 of the pad and is spaced a small distance from the central portion of the mid-section 22 of the pad. As shown in FIG. 3, the elongated cushioning members 16 are positioned beneath the seat and side portions of the rider R for the purpose of providing a cushioning action between these portions of the rider R and the adjacent portions of the back and sides of the horse (not shown).

The cushioning members 18 extend from the front section 20 of the pad rearwardly through the side portions 24 thereof and are of a length that is approximately half the length of the pad 10. Each of the cushioning members 18 is generally L-shaped with a leg 30 extending through the side portion 24 adjacent to and outwardly of the cushioning member 16 on the same side of the pad. The shorter arm portion 32 of each cushioning member 18 extends inwardly from the leg portion 30 to a point adjacent the V-shaped opening 28 in the lower pad portion 14 and the forward end of the adjacent cushioning member 16. As shown in FIG. 3, the cushioning members 18 are positioned in the pad 10 so as to be located between the upper leg portions of the rider R and the sides of the horse for the purpose of providing a cushioning effect therebetween. It is noted that a saddle (not shown) would normally be positioned between the rider R and the pad 10 in FIG. 3. For the purpose of clarity, however, the saddle is omitted from FIG. 3.

The pad portions 12 and 14 and the cushioning members 16 and 18 are formed of a flexible and resilient material, such as foamed polyurethane. The pad portions and cushioning members may be formed of the same or different flexible and resilient materials.

Figure 4:
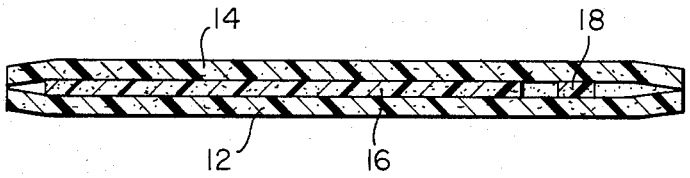
FIG. 4 is a sectional view taken substantially along line A—A in FIG. 3.
Figure 5:
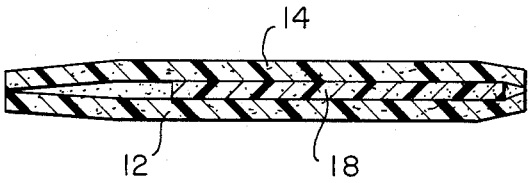
FIG. 5 is a sectional view taken substantially along line B—B in FIG. 3.

Also, the pad portions 12 and 14 and the cushioning members 16 and 18 are secured together in any suitable manner, such as by a suitable adhesive, heat-sealing or stitching. As shown in FIGS. 4 and 5, the adjacent edge portions of the pad portions 12 and 14 which extend outwardly beyond the cushioning members 16 and 18 are secured together in a similar manner.

As an illustrative example, in a saddle pad 10 for a horse and saddle of generally normal size, the length of the pad 10 may be approximately 22 inches, the width of the pad at the front section thereof may be approximately 17 inches, the width at the rear section thereof may be approximately 11 inches, the length of the cushioning members 16 may be approximately 14 inches, the width of the cushioning member 16 may be approximately 4 inches, the length of the cushioning members 18 may be approximately 9 inches, with the width of the leg 30 being approximately 3 inches and the length of the arm 32 being approximately 6 inches. If formed of a polyurethane foam or the like, the thickness of the pad portions 12 and 14 and the cushioning members 16 and 18 may be approximately ⅜ of an inch.

Figure 6:
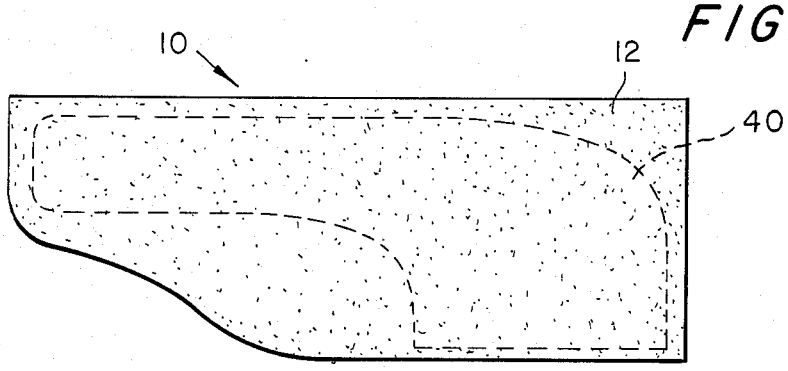
FIG. 6 is a side elevational view of a second embodiment of the saddle pad of the present invention.

The provision of separate cushioning members 16 and 18 in the pad 10 provides for maximum flexibility of the pad so that it can conform easily to the shape of the underlying horse and overlying saddle. Within the scope of the present invention, however, the cushioning portions 16 and 18 on each side of the pad could be formed as a single member 40 as shown in FIG. 6. The cushioning member 40 would have a size and shape that would be generally the same as the overall size and shape of the cushioning members 16 and 18 on one side of the saddle pad so as to provide the same cushioning effect as the separate cushioning members on each side.

The four cushioning members 16, 18 or the two cushioning members 40 in the modified embodiment of FIG. 6 serve to effectively cushion impact on the back and sides of the horse caused by the seat and legs of the rider resulting from movement of the horse and rider, thereby significantly reducing soreness and possible lameness of the horse caused by such impact. The cushioning effect is increased by the use of a suitable flexible and resilient material for the upper and lower pad portions and the cushioning members disposed therebetween This combination of novel features, therefore, provides a saddle pad which closely conforms to the shape of the horse and saddle and provides adequate cushioning for both the horse and rider to increase the comfort of both during riding movement.

A further feature of the saddle pad of the present invention is that the side sections 24 of the pad are of a width such that they terminate above the knee and lower leg portions of the rider, as shown in FIG. 3. This allows the knee and lower leg portions of the rider to have better contact with the sides of the horse through the adjacent saddle flaps or skirt portions (not shown) so as to provide more effective control of the horse through adequate leg contact.

What is claimed is:

1. A saddle pad for a horse or the like, said saddle pad having a predetermined saddle-supporting contour and comprising:

an upper pad portion having substantially said predetermined contour;

a lower pad portion having substantially said predetermined contour; and flexible and resilient cushioning means disposed between said upper and lower pad portions, said cushioning means being located in the areas where the seat and upper leg portions of a rider apply pressure to the horse to cushion shocks caused by riding movement and to prevent soreness of the horse;

said cushioning means comprising first elongated cushioning members extending from the rear section of the pad toward the front section thereof on both sides of and near the mid-section of the pad and second elongated cushioning members extending from the front section of the pad toward the rear section thereof, said second cushioning members being disposed near the outer edges of both side sections of the pad and in laterally outward and adjacent relation to portions of said first cushioning members, each of said second cushioning members being substantially L-shaped with a short arm portion extending toward the mid-section of the pad in front of the adjacent first cushioning member.

2. A saddle pad for a horse or the like, said saddle pad having a predetermined saddle-supporting contour and comprising:

an upper pad portion having substantially said predetermined contour;

a lower pad portion having substantially said predetermined contour; and flexible and resilient cushioning means disposed between said upper and lower portions, said cushioning means being located in the areas where the seat and upper leg portions of a rider apply pressure to the horse to cushion shocks caused by riding movement and to prevent soreness of the horse;

said cushioning means comprising first elongated cushioning members extending from the rear section of the pad toward the front section thereof on both sides of and near the mid-section of the pad and second elongated cushioning members extending from the front section of the pad toward the rear section thereof, said second cushioning members extending forwardly of said first cushioning members and being disposed near the outer edges of both side sections of the pad and in laterally outward and adjacent relation to portions of said first cushioning members.

3. The saddle pad of claim 1 wherein said upper and lower pad portions are formed of a flexible and resilient material.

4. The saddle pad of claim 3 wherein said upper pad portion, said lower pad portion and said cushioning means are secured together.

5. The saddle pad of claim 4 wherein said upper pad portion, said lower pad portion and said cushioning means are formed of a foamed thermoplastic material.

6. The saddle pad of claim 2 further comprising side sections that terminate above the area of the knees and lower peg portions of a rider to provide for good leg contact of the rider with the sides of the horse.

7. A saddle pad for a horse or the like, said saddle pad having a predetermined saddle-supporting contour and comprising:

an upper pad portion having substantially said predetermined contour;

a lower pad portion having substantially said predetermined contour; and flexible and resilient cushioning means disposed between said upper and lower pad portions, said cushioning means being located in the areas where the seat and upper leg portions of a rider apply pressure to the horse to cushion shocks caused by riding movement and to prevent soreness of the horse;

said cushioning means comprising first elongated cushioning members extending from the rear section of the pad toward the front section thereof on both sides of and near the mid-section of the pad and second elongated cushioning members extending from the front section of the pad toward the rear section thereof, said second cushioning members being disposed near the outer edges of both side sections of the pad and in laterally outward and adjacent relation to portions of said first cushioning members;

said lower pad being provided with a generally V-shaped opening in the middle of the front portion thereof, and the front portions of said first and second cushioning members being disposed adjacent to said opening.

* * * * *

UNITED STATES PATENT AND TRADEMARK OFFICE

CERTIFICATE OF CORRECTION

PATENT NO. : 4,827,701

DATED : May 9, 1989

INVENTOR(S) : Anthony Gonzales

It is certified that error appears in the above-identified patent and that said Letters Patent is hereby corrected as shown below:

Column 4, line 11, after "lower", insert --pad--.

Signed and Sealed this

Fifth Day of December, 1989

*Attest:*

JEFFREY M. SAMUELS

*Attesting Officer*

*Acting Commissioner of Patents and Trademarks*